US008591141B2

(12) United States Patent
Owegeser

(10) Patent No.: US 8,591,141 B2
(45) Date of Patent: Nov. 26, 2013

(54) MOBILE PAVING MACHINE

(75) Inventor: Johann Owegeser, Illerrieden (DE)

(73) Assignee: SMG Sportsplatzmachinebau GmbH, Vonringen (DE)

( * ) Notice: Subject to any disclaimer, the term of this patent is extended or adjusted under 35 U.S.C. 154(b) by 0 days.

(21) Appl. No.: 13/227,888

(22) Filed: Sep. 8, 2011

(65) Prior Publication Data

US 2012/0063847 A1 Mar. 15, 2012

(30) Foreign Application Priority Data

Sep. 10, 2010 (DE) ..... 20 2010 012 455 U

(51) Int. Cl.
*E01C 23/07* (2006.01)
*E01C 19/22* (2006.01)

(52) U.S. Cl.
USPC ..... 404/84.1; 404/118

(58) Field of Classification Search
USPC ..... 404/84.1, 84.05, 84.5, 102, 118
See application file for complete search history.

(56) References Cited

U.S. PATENT DOCUMENTS 3,158,945 A * 12/1964 Curlett et al. ..... 172/4.5
3,236,163 A 2/1966 Ackerman et al.
3,286,606 A * 11/1966 Layton ..... 404/95
3,334,560 A * 8/1967 Long et al. ..... 404/84.2
3,356,261 A * 12/1967 Stein ..... 222/63
3,519,770 A * 7/1970 Long et al. ..... 200/61.42
3,648,575 A * 3/1972 Rasmussen ..... 404/84.05
3,771,892 A * 11/1973 Munyon et al. ..... 404/84.1
3,811,787 A * 5/1974 Beaty et al. ..... 404/84.1
4,948,292 A * 8/1990 Haven et al. ..... 404/84.2
5,362,176 A * 11/1994 Sovik ..... 404/72
5,492,433 A * 2/1996 Mosier et al. ..... 404/84.1
5,599,134 A * 2/1997 Macku et al. ..... 404/84.1
5,702,201 A 12/1997 Macku et al.
8,047,741 B2 * 11/2011 Von Schonebeck et al. ..... 404/84.05

FOREIGN PATENT DOCUMENTS

DE 1534319 10/1971
DE 69910571 T2 7/2001

* cited by examiner

*Primary Examiner* — Thomas B Will
*Assistant Examiner* — Abigail A Risic
(74) *Attorney, Agent, or Firm* — Loginov & Associates, PLLC; David M. Driscoll; William A. Loginov

(57) ABSTRACT

The invention concerns a mobile paving machine for the installation of ground covering material, with a smoothing board for stripping off the ground covering material, the smoothing board being adjustable in height and the paving machine having a probing unit with a probing foot, which probes the ground level and acts on the position of the smoothing board so that the ground covering material is flush with the ground level, wherein and the probing unit has a probing foot held by a probe support, which is articulated to a support joint, and wherein a sensor or switch unit is provided, held by a switch support, and the switch support is articulated to the probe support and interacts with the sensor or switch unit on the probe support.

23 Claims, 5 Drawing Sheets

MOBILE PAVING MACHINE

FIELD OF THE INVENTION

The invention concerns a mobile paving machine for the installation of ground covering material consisting of synthetic coatings, elastic base layers or ground pavement, wherein the paving machine has a smoothing board for stripping off the ground material and the smoothing board is adjustable in its vertical position by a height adjustment device and the paving machine has a probing unit with a probing foot, which probes the ground level next to the paving machine, and the probing unit acts on the position of the smoothing board via the height adjustment device so that the ground covering material is flush with the ground level.

BACKGROUND OF THE INVENTION

The above-described paving machines are well known in the prior art. They are used, for example, to install synthetic athletic coating layers on playgrounds, small sports fields, athletic tracks or school athletic facilities and the like. The procedure is such that a plurality of ground covering strips are installed next to each other, one after another, and of course it is desirable that the individual strips be joined seamlessly to each other. Besides a seamless joint, a flush (i.e., no offset) junction of the individual strips is naturally also important. Since it is basically impossible to ensure that the substratum is exactly prepared in the appropriate manner, these paving machines must have corresponding accessory equipment.

The known paving machines are outfitted with smoothing boards, which generally oscillate perpendicular to the direction of travel of the paving machine and thus compact the ground covering material on the substratum, and also smooth it out. At least the oscillatory motion of the smoothing board overlaps the width of the running gear to ensure a seamless joining of the individual strips of ground paving material.

The known paving machines serve to install synthetic coverings, elastic base courses or ground pavements and the like. These ground covers generally consist of ground covering material that is loosely flowing at least during its processing. By ground covering material is therefore meant in the sense of this application that friable and also granular material which then forms the base course in the installed state. The most diverse chemical or physical mechanisms are known for the binding of the granular material; for example, this can be done by mixing in a binder or an adhesive, or also by thermal activation and the like. The term ground covering material is not confined to a special configuration of the material, it can consist of synthetic or mineral raw materials, etc. The invention is not restricted by this.

In order to achieve a flush joining of the individual ground strips with each other, it is known in the prior art how to use a probing unit that interacts in suitable manner with the height adjustment device responsible for the vertical position of the smoothing board. The height adjustment device also has the basic task of determining the layer thickness of the ground covering material being installed. If an inaccuracy results in the substratum, this is corrected in the base course and possibly by raising or lowering the smoothing board, which then changes accordingly the resulting layer thickness of the ground covering material.

It is also the same to the invention if a defined, uniform height offset needs to be achieved (for example, one of a few millimeters or centimeters), which is possible by a corresponding displacement of the offset in the layout of the invented proposal. The flush joining can also be applied to this instance as well.

In the prior art there are known probing units that work without contact to determine the distance of the ground level next to the paving machine from the stationary probing foot and to act accordingly on the height adjustment device. Of course, this involves the ground level of the covering strip already laid down in the previous work step or a corresponding border level (such as a curb stone, etc.). In any case, these methods are not sufficiently accurate.

SUMMARY OF THE INVENTION

The problem of the invention is to propose a paving machine whose work product is much more exact than that of the known ones, especially in regard to the flush joining of the individual ground covering strips.

To solve this problem, the invention starts with a paving machine as described above and proposes that the probing unit has a probing foot held by a probe support, the probe support is articulated to a support joint, and a sensor or switch unit is provided, held by a switch support, and the switch support is articulated to a joint on the probe support. The probe support interacts with the sensor or switch unit depending on the position of the probe support and/or the position of the joint on the probe support.

In one advantageous modification of the invention, the switch support has switch support segments extending on either side of the joint. These switch support segments can have equal or unequal lever arms. Thanks to this configuration of the switch support, the switching sensitivity or sensing capability is further improved, since the responsiveness of the overall device can be further refined thanks to the adjustable lever arms. This then improves the ability to operate the switch.

It has proven to be advantageous for the probe support to be variable in length, in particular, telescopic, for in this way one can adjust the desired positioning accuracy. This positioning accuracy depends, on the one hand, on the paving specifications, and on the other hand on the configuration of the material being paved and the pavement surroundings.

The probe support in a preferred modification of the invention can also have segments extending on either side of the joint, one segment being provided that extends from the joint to the support joint. It is considered to be advantageous for this segment to be shorter than the segment that extends from the joint in the direction of the probing arm. The segments can have a length ratio of 1:1 to 1:4, especially 1:1 to 1:3, preferably from 1:1 to 1:4.

On the whole, the lowering movement of the probing foot results in a lowering swivel movement of the probe support about the pivot joint. Thanks to the joint, which is arranged on the probe support, the switch support also moves in identical fashion. It is advantageous for the probing foot and also the leveling stop to be on the same side in relation to the joint. This results in an equidirectional torque that leads to a corresponding counter-torque in the region of the switching layout and presses the pin, provided in the switching layout, with greater force against the support contact surface. The equidirectional torque can be influenced by correspondingly advantageous adjustment of the respective lengths of the segments. Depending on the chosen segment length, one can influence the lever action and, through it, the switch hysteresis. This produces a better responsiveness or adjustability thereof.

The above-mentioned length ratios refer, on the one hand, to the ratios of the individual segments of the respective supports to each other, but also equally to the ratios of the switch support segments and the probe support segments to each other. The aforementioned length ratios constitute only key points, and naturally all length ratios lying between them can also be adjusted. The length ratios of the switch support segments to each other can also depart from those of the probe support segments to each other. On the whole, a significantly improved adjustability and, thus, sensing accuracy of the overall device is achieved.

The proposals according to the prior art are distinguished by a probing foot that is rigid in terms of its position on the paving machine and that has a sensor unit that measured the distance of the rigidly mounted probing foot from the ground level.

According to the proposal of the invention, now, the probing foot is arranged on a swiveling probe support, which is articulated with a rotary joint, so that the probing foot can essentially be placed on or against the ground level. In this way, an unevenness in the ground level next to the strips being installed leads to a directly mechanical transpositioning at the probe support, which is picked up by a sensor and switch unit. The sensor or switch unit acts in suitable manner on the height adjustment device and thus closes the feedback control loop.

Another benefit of the invention is that the overall probing unit is arranged on the paving machine of the invention and no additional elements or preparations are needed at the construction ground or the construction site to produce base courses lying flush and free of offset against each other (and also seamless, which does not characterize the invention, but advantageously modifies it).

In one preferred embodiment of the invention, the vertical position of the sensor or switch unit is changeable, in particular, it can be changed by the height adjustment device. Thanks to such a configuration, a corresponding vertical adjustment of the position of the smoothing board is also transmitted at the same time to the position of the sensor and switch unit and thus the reference line of the sensor and switch unit is also the same for changed position of the reference surface (the ground level). Alternatively, it is of course possible to have a fixed configuration of the position of the sensor or switch unit on the paving machine of the invention.

In one preferred embodiment of the invention it is proposed that the sensor or switch unit is held by a switch support, which is articulated to a joint on the probe support.

Since the probe support senses the rising or lowering motion of the probe foot due to the changing ground level, this arrangement transmits this height information to the sensor or switch unit. In addition, however, the displacement of the height adjustment device also acts on the switch support or the vertical position of the sensor or switch unit.

It should be noted in this context that the term vertical describes here any movement or direction that describes at least a component in the vertical direction, including at a slant to the vertical.

In a preferred embodiment of the invention, it is proposed that the joint on the probe support is located between the probing foot and the support joint. Usually, the joint between support joint and probing foot is arranged rather centrally or in the middle. The resulting section lengths, however, can also be different, or significantly different (for example, greater than the ratio 1.5:1 or 2:1). Both the section from the probing foot to the joint and the section from the joint to the support joint can be larger or smaller than the other section.

In one preferred embodiment of the invention, the vertical position of the support joint is changeable, in particular, it can be changed by the height adjustment device, where the height adjustment device raises or lowers the support joint in the same manner as the smoothing board. The position of the support joint ultimately determines the angle of inclination of the probe support and thus also the actuating of the sensor or switch unit. An identical movement in the vertical direction (where the vertical direction can also, of course, be an upward slanting movement according to the invention) results in the reference position also being dynamically adapted with the desired layer thickness of ground cover material being deposited or the changeable position of the ground level. Advisedly the smoothing board and the support joint are arranged on a shared combination support and thus rigidly coupled to each other.

Advisedly, in one modification of the invention, a leveling stop is provided on the sensor or switch unit or the switch support. Thanks to the leveling device, a movement is attained, especially a rotation of the sensor or switch unit about the joint. The invention is very flexible in regard to the layout or configuration of the leveling stop. It is possible to realize this leveling stop both in the independently mounted sensor or switch unit and in the solution where the sensor or switch unit is arranged on the switch support.

Furthermore, the invention includes in one advantageous embodiment a bearing element that can change its vertical position by the height adjustment device and that interacts with the leveling stop. Advisedly, this bearing element will also change its vertical position in the same manner as the smoothing board or the support joint. For this, for example, the bearing element is connected to a shared support with at least the smoothing board and/or the support joint, or it is raised or lowered in the same way by the height adjustment device. For example, the bearing element can be configured as a stop or shoulder. When interacting with the leveling stop, it can be brought into working position from above, from below, or sideways.

The configuration of the switch support is similar to a rocker, so that the joint at which the switch support is arranged on the probe support is located between the leveling stop and the sensor or switch unit. In this way, thanks to an interacting of the leveling stop with, say, the bearing element, as proposed in the invention, the switch support is turned about the axis of the joint and then the sensor or switch unit undergoes a corresponding position change or is subjected to torque or force.

Advisedly, the invention proposes that the sensor or switch unit defines at least three positions and the sensor or switch unit interacts with a support contact surface of the probe support so that the sensor or switch unit can assume one of the three positions, namely, raising or lowering of the height adjustment device and a neutral position. This preferred configuration of the sensor or switch unit can be realized in both of the variants provided by the invention. The invention includes both a solution in which the sensor or switch unit is not supported by the probe support, but interacts with it, and the variant in which the sensor or switch unit is connected or incorporated as described, via the switch support and the joint on the probe support. By appropriate activation of the sensor or switch unit in interaction with a support contact surface of the probe support, the sensor or switch unit takes up one of the three mentioned positions and controls the height adjustment device accordingly, which in turn raises or lowers the smoothing board and the other elements connected with it, or remains unchanged in position.

In one preferred embodiment of the invention, the sensor or switch unit is configured as a switching arrangement and a pin of this switching arrangement interacts with the support contact surface against the force of a spring and takes up one of the at least three positions.

It has been found to be advantageous for the smoothing board to be heatable. In particular, the bottom base of the smoothing board next to the ground cover material is heatable. This energy can be used, for example, for a compacting or a consolidation, or for increasing the sliding quality of the binder of the ground cover material.

The proposal of the invention can be quite variable in regard to the configuration of the probing foot. Thus, in a first variant, a relatively short probing foot is proposed, whose length in particular is less than 10% of the length of the paving machine. With a relatively short probing foot, of course, a very fast reaction of the height adjustment device (occurrence of corresponding fluctuations in ground level) is revealed. With a somewhat longer probing foot, the speed of response is less in this regard, so that in an alternative embodiment of the invention a longer probing foot is provided, whose length is greater than 80% of the length of the paving machine. In particular situations it can be of advantage, in particular, for the long probing foot to be preferably longer than 80% of the length of the paving machine.

The probing foot is connected by a probing arm to the probe support. In a preferred variant of the invention, the probing foot is mounted at a bearing point on the probing arm, and in particular the bearing point can change along at least part of the lengthwise dimension of the probing foot. Such a configuration is realized, for example, by a rodlike probing foot, having a slot or gap on its top side, and a certain region of the probing foot is dragged behind the bearing point and also behind the paving machine (=drag rod), in this case the bearing point being defined by the end of the lengthwise slot. Of course, the bearing point in such a configuration can be adjusted as desired along the lengthwise dimension of the probing foot by appropriate clamping devices.

The probing arm extends basically vertically and carries the probing foot at its lower end. The probing foot senses the ground level next to the paving machine. For this, the probing arm is mounted or held in a probe support extending basically horizontally. The effective length of this probe support can be changed so that, for example, it is telescopic. In this way, the distance at which the ground level next to the paving machine is sensed can be adjusted.

In one preferred embodiment of the invention, the height adjustment device has at least one guide, for example, an adjusting spindle or the like, as well as a height adjustment drive, for example, a rotational drive for the adjusting spindle (configured as an electric motor, for example). It should be emphasized here that this is only one variant of the configuration of the height adjustment device. Indeed, there are many equivalent variants available for this.

In one preferred embodiment of the invention, the bearing element is arranged on the guide, wherein the bearing element is configured in particular as an adjusting nut arranged on the adjusting spindle. The adjusting spindle carries the smoothing board and/or the support joint, for example, by an additional nut.

The invented configuration is chosen so that, depending on the switch setting of the sensor or switch unit, a raising or lowering command goes to the height adjustment device, in particular, to the height adjustment drive.

In one preferred embodiment of the invention, the length of the switch support piece between the joint and the leveling stop is smaller than the length of the switch support piece between the joint and the sensor or switch unit. In particular, the length of the switch support piece between the joint and the leveling stop is less than half, in particular less than ⅓ the length of the switch support piece between the joint and the sensor or switch unit. Thanks to these levers of different length, a small effect produces a large action, that is, a small path change on the one hand produces a large path change on the other hand. In this way, the sensitivity of the overall probing unit can be adjusted.

Basically, the proposal of the invention can be realized both with a noncontact and a contact-type sensing of the ground level by the probing foot. In a noncontact sensing of the ground level by the probing foot, a special drive is provided for the position of the probing foot and the sensor arrangement provided for this only ensures that the distance of the probing foot above the ground level remains constant. Thus, for example, a mechanical influencing of the ground level by the probing foot can be prevented. The correction of the position of the probing foot relative to the ground level, for example, due to corresponding unevenness of the ground level, then results in a corresponding position change of the probing foot itself and, in this way, also to a corresponding deflection of the probe support, which carries the probing foot and its support joint.

Alternatively, the contact-type sensing of the ground level by the probing foot is provided, in which the relatively complicated sensor layout is eliminated.

In one preferred embodiment of the invention, the paving machine is an automotive unit, i.e., outfitted with a running gear and drive system, or it is configured as a towed vehicle. The automotive arrangement is preferred, since this is basically space-saving and results in a more accurate work result, but the towed configuration is equally possible and provided according to the invention.

BRIEF DESCRIPTION OF THE DRAWINGS

The invention is depicted schematically in the drawing, especially in a sample embodiment. There are shown.

DETAILED DESCRIPTION

In the figures, the same or corresponding elements are always designated with the same reference number and therefore are not described again, since it is not necessary.

Figure 1:
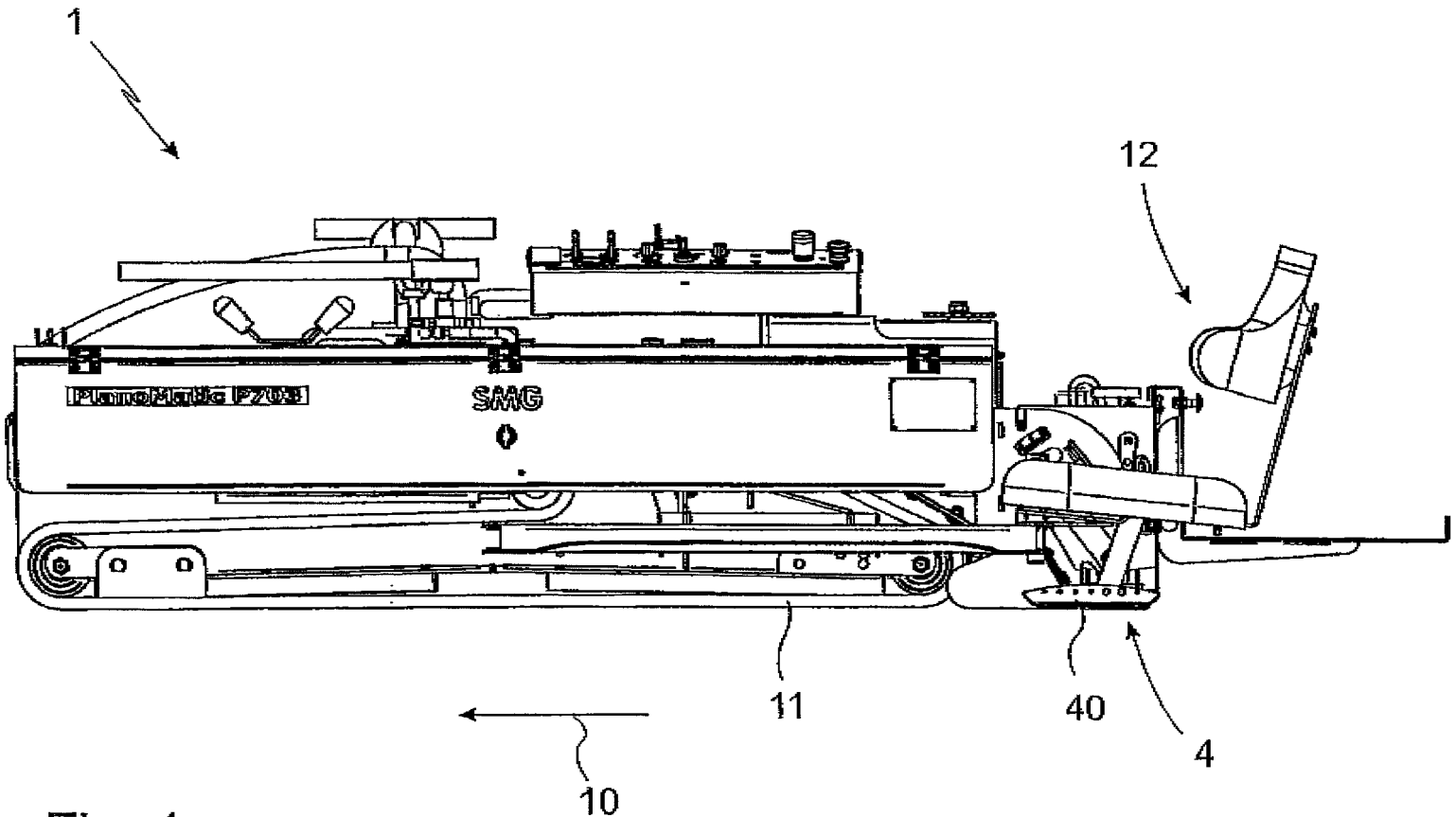
FIG. 1, the paving machine of the invention in a side view.

The paving machine 1 according to the invention is shown in FIG. 1. The paving machine 1 has a caterpillar drive 11, by which it is possible for the paving machine to also operate safely on poorly consolidated substratum. The preferred direction of travel of the paving machine 1, especially its paving direction, is pointing to the left and indicated by arrow 10. At the rear end in the direction of travel 10 is located the probing unit 4, of which its probing foot 40 is easily identifiable.

Likewise in the rear area in the direction of travel is situated the driver's seat 12, the rear location of the seat 12 enables a direct overseeing of the work result, since the smoothing board 2 is also situated in the rear area of the paving machine 1 (in terms of its direction of travel 10). In the side view shown in FIG. 1, the smoothing board 2 is basically located behind the probing foot 40 and is concealed by this.

Figure 2:
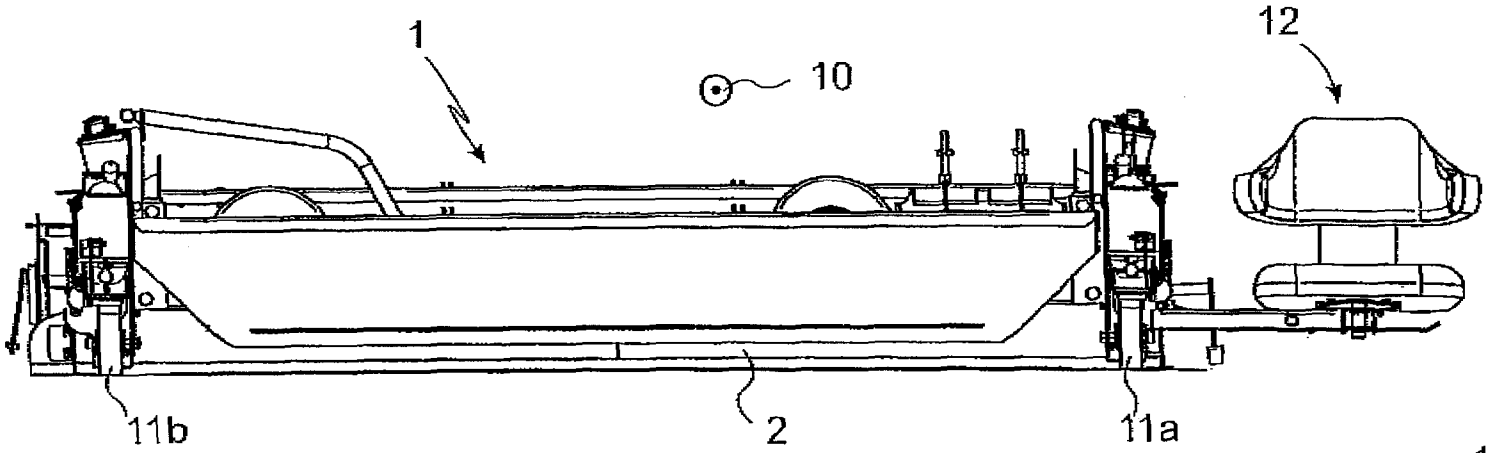
FIG. 2, the paving machine of the invention in a front view.

In FIG. 2, the paving machine 1 is shown in front view. The direction of travel 10 here is directed at the observer. The smoothing board 2 extends transversely, especially at right angles to the direction of travel 10, and is arranged in the lower region of the paving machine 1. The two caterpillar tracks of the caterpillar drive 11 are marked with 11*a* and 11*b*, extending at left and right of the paving machine 1.

Figure 3:
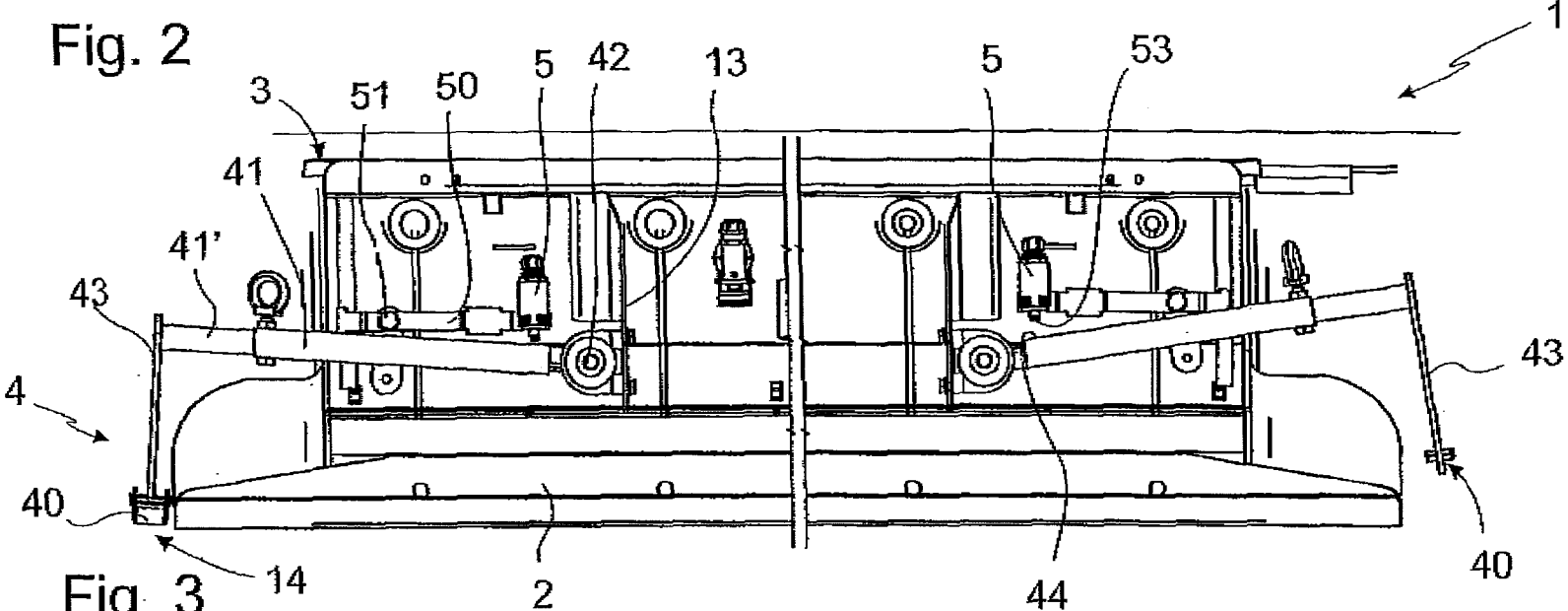
FIG. 3, two different positions of the probing unit according to the invention in a combined sectional representation.

A more detailed overview of the invented paving machine 1 results in particular from the representation of FIG. 3. FIG. 3 shows a partial section through the paving machine 1 at the height of the height adjustment device 3, the representation being split up, so that different positions of the probe support 41 are shown left and right.

In FIG. 3 the probing unit 4 is especially recognizable. The probing unit 4 is joined by the support joint 42 to the frame 13 of the paving machine. In particular, the support joint 42 can move vertically in the frame 13, the vertical position of the support joint 42 being set by the height adjustment device 3.

The probing unit 4 comprises a probing foot 40, which stands on the ground level 14 alongside the paving machine 1. Usually the probing unit 4 is placed on the side of the paving machine where a strip of ground cover material has already been installed on the particular surface and which is now being joined flush with the strip of ground cover material currently being laid down. The position of the support joint 42 is approximately ⅓ of the overall width of the paving machine, which produces a corresponding lever arm of the probe support 41. The probe support 41 is telescopically extensible, there being provided a tube 41' that can be shoved into the probe support 41.

The probing foot 40 is located on the probing arm 43, the probing arm 43 essentially connects to the end of the probe support at an angle, especially a right angle, to its telescopic tube 41', and extends downwards.

The sensor or switch unit 5 is carried by a switch support 50. The switch support 50 in turn is articulated by a joint 51 to the probe support 41.

Figure 4:
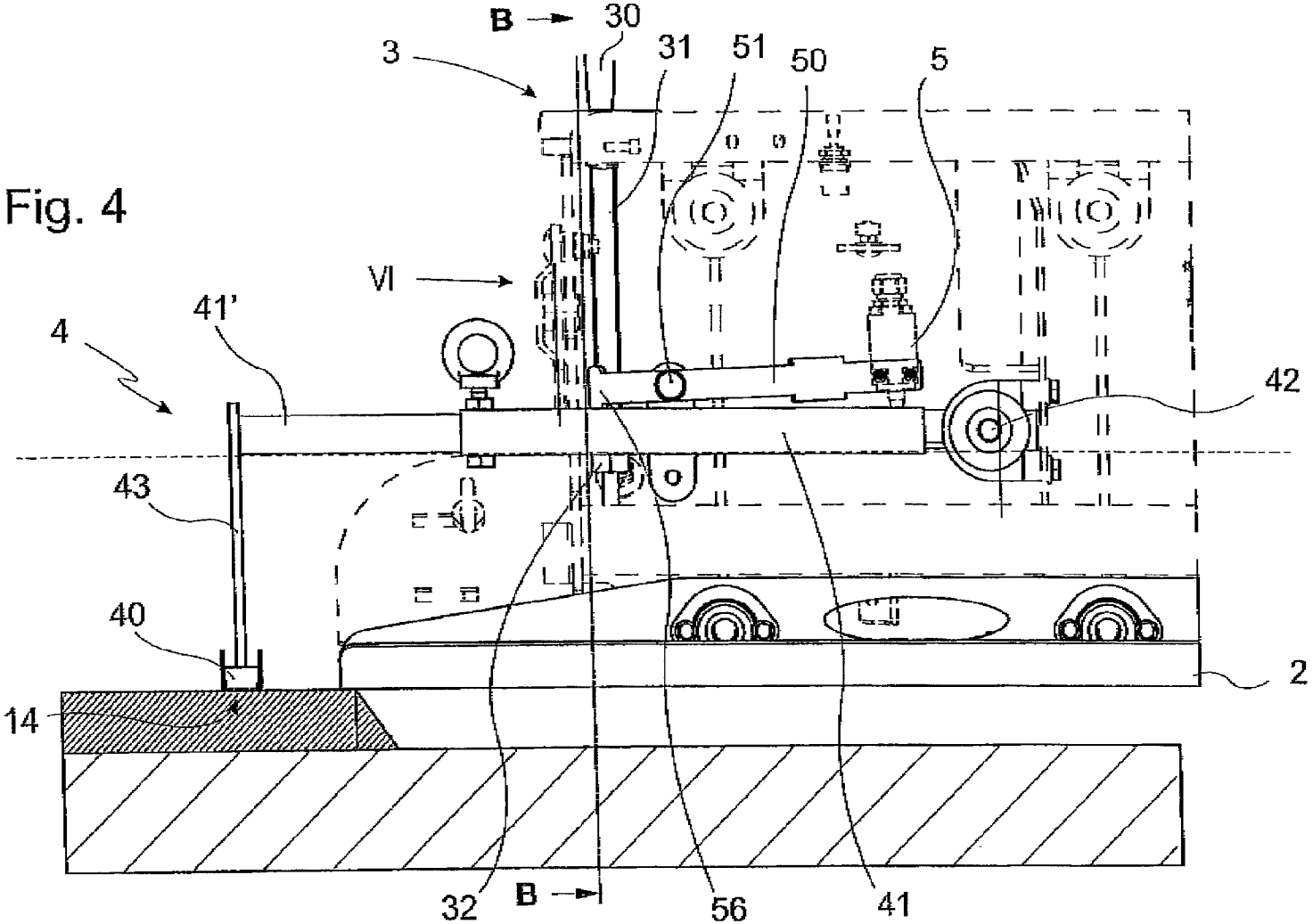
FIGS. 4, 5, the probing unit according to the invention in a magnified detail.
Figure 5:
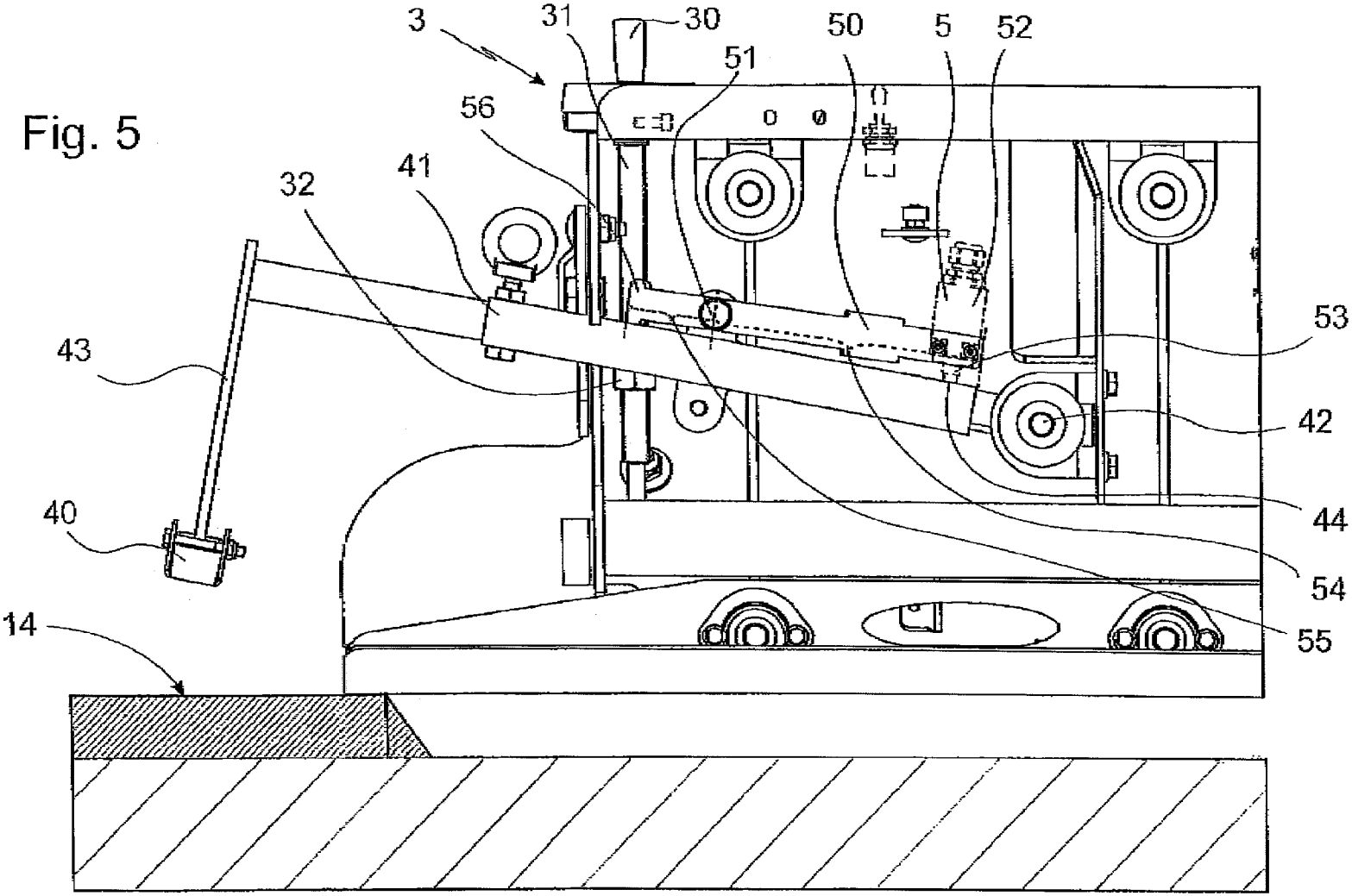

FIGS. 4 and 5 show the specific configuration of the sensor or switch unit 5 in enlarged scale.

The height adjustment device 3 is characterized by a height adjustment drive 30, for example, an electric motor, which is arranged in the upper region. The height adjustment device 3 furthermore comprises a guide or adjusting spindle 31, which is oriented vertically and arranged on the paving machine 1. In the sample embodiment shown here, the height adjustment drive 30 moves the adjusting spindle 31 in rotation about its longitudinal axis. On the adjusting spindle 31 are placed one or more spindle nuts, which change their axial position according to the rotation of the adjusting spindle 31. In this way, for example, one can realize a mounting of the smoothing board 2 and/or the support joint 42, so that these elements are mounted in suitable height-adjustable manner, in particular, vertically height-adjustable.

It is clear that the arrangement is implemented on both sides for a synchronized operation, i.e., a corresponding outfit is provided on both the left and the right side of the paving machine 1.

The sensor or switch unit shown in FIGS. 4 and 5 is implemented here in particular as a switching arrangement 52. This switching arrangement has a pin 53, which sticks out downward from the switching arrangement 52 and can move axially. This pin 53 is buttressed in the switching arrangement 52 by a spring and works together with the support contact surface 44 of the probe support 41. In the sample embodiment shown here, the support contact surface 44 is found relatively close to the support joint 42. Of course, the invention also includes arrangements that are realized spatially in the opposite sense.

The switching arrangement 52 according to the sample embodiment shown here is now chosen such that the switching arrangement 52 takes up at least three different positions. These three different positions are indicated by the axial position of the pin 53, resulting from the interaction of the pin 53 with the support contact surface 44 against the force of the spring in the switching arrangement 52.

Figure 6:
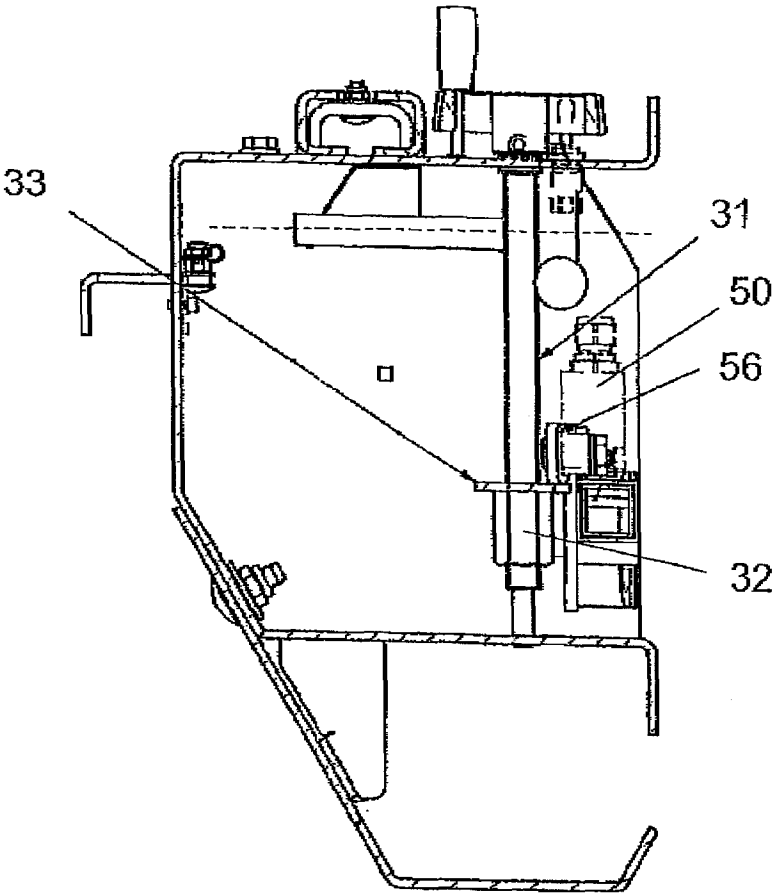
FIG. 6, a side view in the direction of arrow VI in FIG. 4.

The basic configuration of the switch support 50 is a rocker arm, so that the switch support 50 extends on both sides of the joint 51. The right segment 54 of the switch support carries at its out end the switch arrangement 52, the left segment 55 of the switch support, which extends to the left from the joint 51 as far as a leveling stop 56 situated there, is considerably shorter. The mode of operation of the leveling stop 56 results in particular from FIG. 6.

The leveling stop 56 interacts (directly or indirectly) with the bearing element 32. The bearing element 32 is fashioned as a spindle nut and located on the adjusting spindle 31. The bearing element 32 has a bearing plate 33, on which the leveling stop 56 is able to rest with its broad surface. By an axial movement of the bearing element 32 on the adjusting spindle 31 (for example, due to a rotation thereof), the bearing plate 33 or the bearing element 32 acts on the leveling stop 56. The leveling stop 56 is the end region of the switch support 50 articulating with the joint 51 and facing the adjusting spindle 31. In this way, the position of the switching arrangement 52 relative to the probe support 41 can be influenced.

According to the invention, the sensor or switch unit 5, especially the switching arrangement 52, defines at least three positions and the sensor or switch unit 5 interacts with a support contact surface 44 of the probe support 41 such that the sensor or switch unit 5, especially the switching arrangement 52, takes up one of the three positions: raising or lowering of the height adjustment device, or neutral.

The neutral position is given in that the probing foot 40 lies against the ground level, the leveling stop 56 lies against the bearing element 32, and the pin 53 lies against the support contact surface 44 and the switching arrangement 52 is in a first depressed position, wherein this first switch position gives no signal to the height adjustment device 3 or its height adjustment drive 30.

The right side of FIG. 3 shows the situation in which the probing foot 40 is for example lifted by an unevenness and so the switching arrangement 52 is lifted from the support contact surface 44 and so the pin 53 ends up in a first signal-emitting position against the force of the spring (not shown). Thus, the arrangement for a lifting of the smoothing board 2 is achieved and a corresponding command is sent by the sensor or switch unit 5 to the height adjustment device 3.

The lowering position is especially clear in FIG. 5. It will be noticed that the axial position of the bearing element 32 on the adjusting spindle 11 is further up than in FIG. 4. The probing foot 40 in the position of FIG. 5 strives to sink down. This downward movement of the probe support 41 is limited or its length is dictated by the leveling stop 56. The chain of action is represented as follows.

The lowering movement of the probing foot 40 leads to a downward swiveling movement of the probe support 41 about the pivot point 42. Thanks to the joint 51, which is arranged on the probe support 41, the switch support 50 also moves in identical manner. It is advantageous for the probing foot 40 and the leveling stop 56 to be on the same side in relation to the joint 51. This produces an equidirectional torque, which in the region of the switching arrangement 52 leads to a corresponding counter-torque and presses the pin 53 with greater force against the support contact surface 44.

Hence, the pin 53 is pushed into the inner position, so that the lowering signal is sent in the switching arrangement 52. There then occurs a corresponding rotation of the adjusting spindle 31 by the height adjustment device 30, the bearing element 32 moves vertically downward until the probing foot 40 rests against the ground level 14 and so a certain relieving of load results in the lever arrangement of switch support 50 and probe support 41. This reduces the force acting on the pin 53 until it is no longer completely pressed into the switching arrangement 52, but instead rebounds into the middle, neutral position, which deactivates the height adjustment drive 30. In this way, the neutral position is reached.

Advantageous in this connection are the unequal lever arms of the two switch support segments 54 and 55 extending on the left and right side of the joint 51, since this further improves the response of the switching arrangement and heightens the positioning accuracy. In regard to the position of the joint 51 on the probe support 41, it should be noted that the length of the probe support 41 is changeable (because it is telescopic). In the shortest variant of the probe support 41, the joint 51 is situated in the middle. Otherwise, however, the right segment of the probe support 41 that extends from the joint 51 to the support joint 41 is shorter than the segment of the probe support 41 that extends outward from the joint 51 to the probing arm 43 connected at its end. The length ratios can vary from around 1:1 to 1:2, 1:3 or even 1:4, thereby also achieving a higher measurement or sensing accuracy on account of the improved response. Due to the lever action and the switch hysteresis that can be influenced in this way, an improvement of the measurement and sensing accuracy is also favorably influenced.

Although the invention has been described by means of precise sample embodiments, which are presented in the greatest detail, it is stipulated that this serves only as an explanation and the invention is not necessarily limited to this, since alternative sample embodiments and procedures are clear to the skilled persons with regard to the disclosure. Accordingly, changes will be considered that can be done without departing from the content of the described invention.

What is claimed is:

1. Mobile paving machine for the installation of ground covering material consisting of synthetic coatings, elastic base layers or ground pavement, the paving machine comprising:

a smoothing board for stripping off the ground covering material and the smoothing board is adjustable in its vertical position by a height adjustment device and the paving machine has a probing unit with a probing foot, which probes the ground level next to the paving machine, and the probing unit acts on the position of the smoothing board via the height adjustment device so that the ground covering material is flush with the ground level, wherein the probing unit has a probing foot held by a probe support, and the probe support is articulated to a support joint, while a sensor or switch unit is provided, held by a switch support, and the switch support is articulated to a joint on the probe support, wherein a vertical position of the sensor or switch unit is changeable, and the probe support is elongated having the probing foot arranged at one end thereof and having the support joint at an opposite free end thereof for supporting the probe support from a frame of the paving machine, and wherein the vertical position of the support joint is changeable, wherein the height adjustment device raises or lowers the support joint, and wherein the probe support interacts with the sensor or switch unit depending on the position of the probe support and/or the position of the joint on the probe support.

2. Paving machine according to claim 1, wherein the switch support has switch support segments extending on either side of the joint and the two switch support segments have equal or unequal lever arms.

3. Paving machine according to claim 1, wherein the probe support is variable in length.

4. Paving machine according to claim 3, wherein the probe support is telescopic.

5. Paving machine according to claim 1, wherein the probe support has segments extending on either side of the joint and one segment is provided that extends from the joint to the support joint.

6. Paving machine according to claim 5 wherein the one segment is shorter than the segment that extends from the joint in the direction of the probing arm.

7. Paving machine according to claim 1, wherein the switch support has switch support segments extending on either side of the joint and the probe support has segments extending on either side of the joint and the segments have a length ratio from one of either of 1:1 to 1:4 and 1:1 to 1:3.

8. Paving machine according to claim 1 wherein at least one of (a) the vertical position is changeable by the height adjustment device, and (b) the sensor or switch unit is held by the switch support and wherein the switch support is articulated to a joint on the probe support, and (c) the joint on the probe support is located between the probing foot and the support joint, and (d) the vertical position of the support joint is changeable.

9. Paving machine according to claim 1 wherein the switch support is an elongated switch support that is maintained substantially in parallel with the elongated probe support, and the joint between the probe support and the switch support is disposed at a location that is intermediate ends of the respective probe support and switch support.

10. Paving machine according to claim 1, wherein at least one of (a) a leveling stop is provided on the sensor or switch unit or the switch support, and further comprising a bearing element that can change its vertical position by the height adjustment device and that interacts with the leveling stop, wherein the joint on is located between the leveling stop and the sensor or switch unit, and (b) the sensor or switch unit defines at least three positions and the probe support has a support contact surface, while the sensor or switch unit interacts with the support contact surface of the probe support so that the sensor or switch unit takes up one of the three positions, raising or lowering of the height adjustment device or neutral, and (c) the sensor or switch unit is configured as a switching arrangement including a pin and a spring and wherein the pin of the switching arrangement interacts with the support contact surface against the force of a spring and takes up one of the at least three positions, in particular, wherein the neutral position is given in that the probing foot lies against the ground level, the leveling stop lies against the bearing element, and the pin lies against the support contact surface and the switching arrangement is in a first depressed position, and (d) wherein one of the at least three positions includes a "raising" position that comprises a raising of the probing foot and resulting lifting of the pin from the contact surface and the unloading position of the switching arrangement defined by this, and (e) wherein another of the at least three positions includes a "lowering" position that is characterized by a lowering of the probing foot, for example, due to a depression in the ground, so that the leveling stop presses against the bearing element and due to the levered, articulated arrangement of the switch support on the joint the contact surface presses the pin into a second depressed position of the switching arrangement.

11. Paving machine according to claim 1, wherein the smoothing board has a bottom base with a heatable surface and wherein the heatable surface is provided on the bottom base of the smoothing board next to the ground cover material.

12. Paving machine according to claim 1, wherein the paving machine has a short probing foot, whose length is less than 10% of a length of the paving machine.

13. Paving machine according to claim 1, wherein the paving machine has a long probing foot, whose length is greater than 80% of a length of the paving machine.

14. Paving machine according to claim 1, wherein the probing foot has a probing arm and a bearing point, and the probing foot is mounted at the bearing point on the probing arm.

15. Paving machine according to claim 14, wherein the bearing point can change along at least part of the lengthwise dimension of the probing foot.

16. Paving machine according to claim 1, wherein the probing foot has a probing arm and a bearing point, and the probing foot is held by the probe support and the length of the probe support is variable, the probe support being telescopic.

17. Paving machine according to claim 1, wherein the height adjustment device has at least one guide, for example, an adjusting spindle or the like, and a height adjustment drive.

18. Paving machine according to claim 1, wherein the height adjustment device has at least one guide, for example, an adjusting spindle or the like, and a height adjustment drive, and wherein a bearing element is arranged on the guide and the bearing element is configured in particular as an adjusting nut arranged on the adjusting spindle.

19. Paving machine according to claim 1, wherein the sensor or switch unit has a switch setting and depending on the switch setting of the sensor or switch unit, a raising or lowering command goes to the height adjustment device, in particular, to a height adjustment drive.

20. Paving machine according to claim 1, wherein the switch support has switch support segments extending on either side of the joint and a leveling stop is provided on the sensor or switch unit or the switch support and a length of the switch support segment between the joint and the leveling stop is smaller than the length of the switch support piece between the joint and the sensor or switch unit.

21. Paving machine according to claim 20, wherein a length of the switch support segment between the joint and the leveling stop is either (a) less than half a length of the switch support piece between the joint and the sensor or switch unit or (b) less than ⅓ the length of the switch support piece between the joint and the sensor or switch unit.

22. Paving machine according to claim 1, wherein a non-contact or a contact-type sensing of the ground level by the probing foot is provided.

23. Paving machine according to claim 1, wherein the paving machine comprises one of an automotive and a towed paving machine.

* * * * *